US006935526B1

(12) United States Patent
Laggar

(10) Patent No.: US 6,935,526 B1
(45) Date of Patent: Aug. 30, 2005

(54) COLLAPSIBLE SECURE CONTAINER

(76) Inventor: Jeffrey Edward Laggar, 26 Sandhurst Avenue, Berkshire Downs, New Germany, 3610 Kwa Zulu Natal (ZA)

( * ) Notice: Subject to any disclaimer, the term of this patent is extended or adjusted under 35 U.S.C. 154(b) by 0 days.

(21) Appl. No.: 10/130,432

(22) PCT Filed: Nov. 16, 2000

(86) PCT No.: PCT/ZA00/00216

§ 371 (c)(1),
(2), (4) Date: May 17, 2002

(87) PCT Pub. No.: WO01/54989

PCT Pub. Date: Aug. 2, 2001

(51) Int. Cl.[7] ..... B65D 6/18
(52) U.S. Cl. ..... 220/7; 220/4.29
(58) Field of Search ..... 220/7, 6, 4.28, 220/4.29; 206/600

(56) References Cited

U.S. PATENT DOCUMENTS 2,221,504 A 11/1940 Beasley et al.
3,611,994 A 10/1971 Bailey et al.
6,155,444 A * 12/2000 Liu ..... 220/7

FOREIGN PATENT DOCUMENTS

| | | |
|---|---|---|
| DE | 1 040 448 | 1/1957 |
| DE | 42 18 408 | 12/1992 |
| FR | 1 062 713 | 4/1954 |
| GB | 1 080 290 | 8/1967 |

* cited by examiner

*Primary Examiner*—Stephen Castellano
(74) *Attorney, Agent, or Firm*—Young & Thompson

(57) ABSTRACT

A secure lockable and collapsible container is provided which finds particular use as a safe storage facility in the bin of bakkies, in boats, trailers or in different sizes in hotel room or lockers. The container includes a tray which has primary sheet members hinged to its low walls to form the walls of a box. These sheet members have formations for engaging adjacent sheet members and one primary sheet member is hinged to a secondary sheet member to complete a box-like arrangement. The sheet members are pivotable from a first position in which they are all, except one, accommodated within the tray, the exception forming a lid for the tray to a second position in which they form the walls of a closed box.

2 Claims, 2 Drawing Sheets

COLLAPSIBLE SECURE CONTAINER

TECHNICAL FIELD OF THE INVENTION

This invention relates to a collapsible secure container for open-backed motor vehicles or the like including boats, trailers, hotel rooms, lockers, motor cycles.

BACKGROUND OF THE INVENTION

Incidences of theft from vehicles and other high risk areas which cannot be adequately secured, has increased substantially in recent times. However, space is limited in the bins of light delivery vehicles and although people have taken to storing individual items within secure containers in the bins, these tend to be bulky and must be periodically removed when not in use. Further, this does not prevent the container being removed, although size and weight may limit such unauthorised removal.

It is therefore an object of this invention to provide a secure container which may be permanently anchored to the vehicle and which further is adapted to the vehicle and which further is adapted to collapse for convenient storage when not in use. The container which may be provided in a variety of sizes, may also find application in boats, trailers, hotel rooms, lockers and even motor cycles.

THE INVENTION

According to the invention, a collapsible container includes a tray:

- the walls of the tray each having hinged thereto primary sheet members the primary sheet members including inter engaging means for releasably engaging adjacent sheet members;
- one of the primary sheet members being further hinged along the opposite edge to a secondary sheet member;
- the sheet members being pivotable from a first position in which all except one are accommodated within the tray, the exception forming a lid for the tray to a second position in which they form the walls of a closed box;
- and means for locking the box thus formed.

In the preferred form of the invention, the tray is adapted to be anchored to a fixed structure, typically a wall of the bin of a bakkie, light delivery vehicle or the like. The tray may include one or more holes therein for receiving bolts or the like fasteners to secure the container in place.

Also in the preferred form of the invention the primary sheet members include along at least two opposed free edges thereof, a short flange. This prevents the insertion of a screwdriver or other lever like tool in an attempt to pry open the container.

Also in the preferred form, the secondary sheet member includes a flange along a third free edge thereof.

The tray preferably comprises the rear wall of the container with the sheet member hinged to the upper edge thereof forming the top panel or lid of the container, and the primary sheet member along the lower edge thereof forming the base of the container. It is to this (base) sheet member that the secondary sheet member is hinged, this secondary sheet member forming the front wall and including a locking mechanism for engaging the lid. In one form the lid includes an angled section extending at least part of the width of the front wall sheet member to form a channel. This receives the flange along the third edge of the front wall and provides in some instances a locking surface for the locking mechanism. The locking mechanism may comprise a cam lock or in an alternative form, a safe-lock.

In one form, the flanges along the top edges of the side wall sheet members may each include a simple catch for engaging the flange along the third edge of the (front wall). This prevents the front wall pivoting flat into the interior of the box during assembly.

In the preferred form, the flanges along the bottom edges of the side walls include recesses for receiving integral pins on the underside of the base sheet member.

In order to assemble the container from its folded condition, the tray is arranged (if not affixed to the rear wall of the cab) in an upright position. The lid sheet member is pivoted vertically away from the front of the tray and then the side wall sheet members are swung outwards. The base sheet member is lowered to the ground and the front wall (or secondary) sheet member is swung upwardly and outwardly. The side walls are swung inwardly to engage the pins on the underside of the base and once secured, the lid is lowered to rest upon the two side walls. Thereafter, the front wall is raised to engage the side wall catches and the lid to form a closed box. The box may then be locked.

In order to disassemble, the box is unlocked and the lid lifted. Thereafter, the side wall catches are released allowing the front wall to pivot inwardly to rest upon the base. The side walls are swung outwardly to permit folding of the base up into the tray and then the side walls are swung inwardly into the tray before the lid pivots down to contain the collapsed box within the tray.

The container may comprise a variety of materials including steel, aluminium, plastic or fibreglass. The typical galvanised steel will be used to provide a very secure container which is not susceptible to corrosion.

DESCRIPTION OF THE EMBODIMENT OF THE INVENTION

An embodiment of the invention is described below with reference to the accompanying drawings in which.

Figure 1:
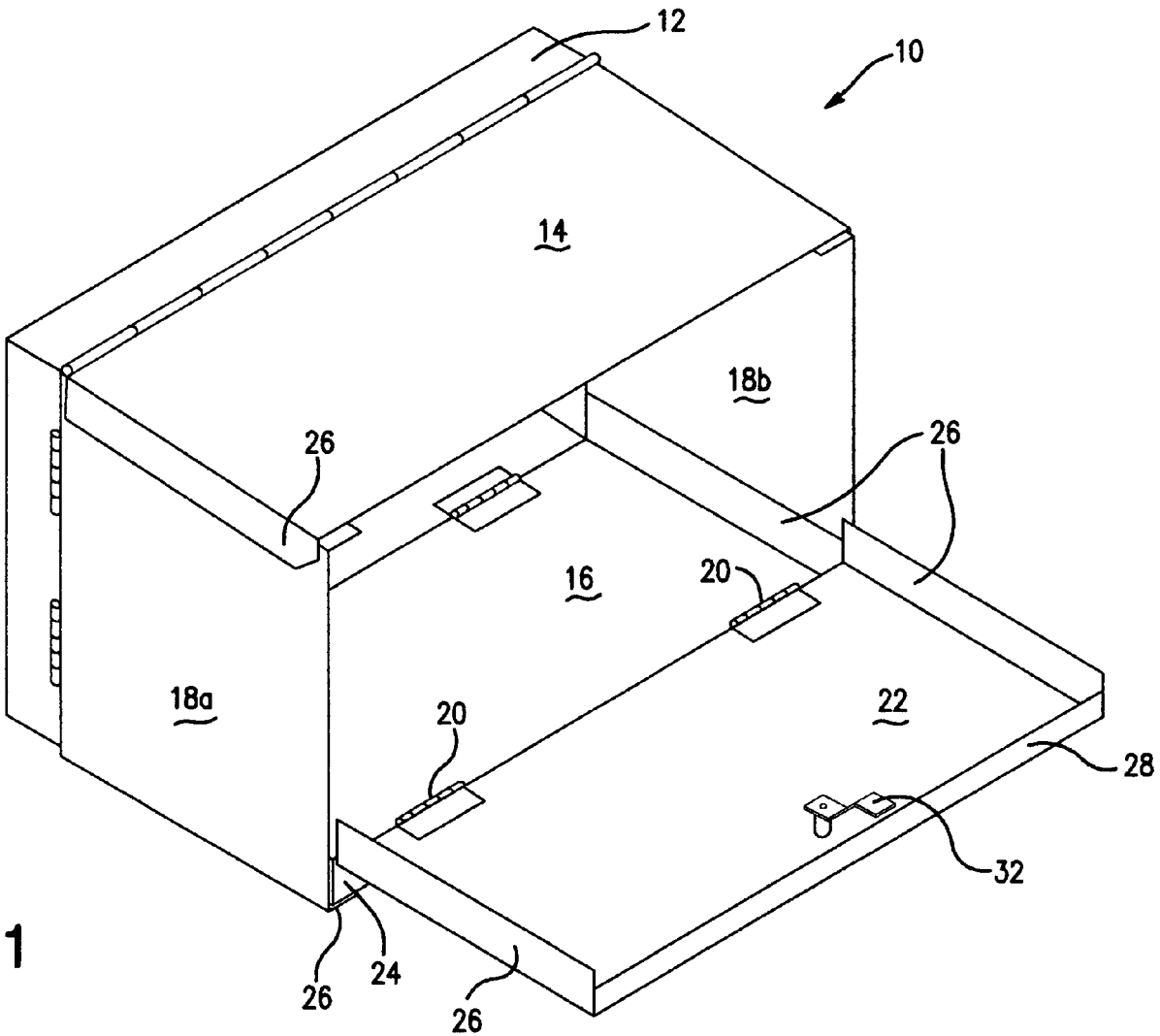
FIG. 1 is an isometric front and side view of a container, partially assembled, according to the invention.
Figure 2:
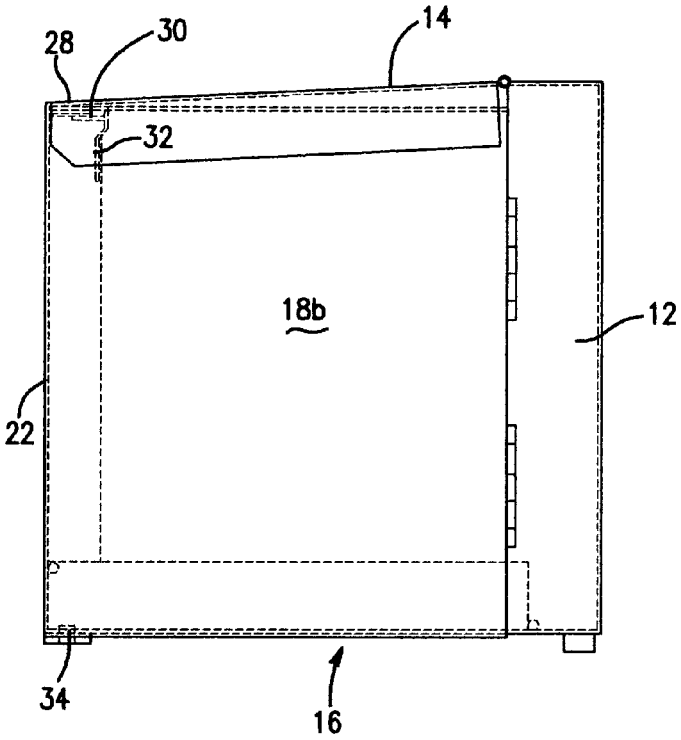
FIG. 2 is a side view of an assembled container.
Figure 3:
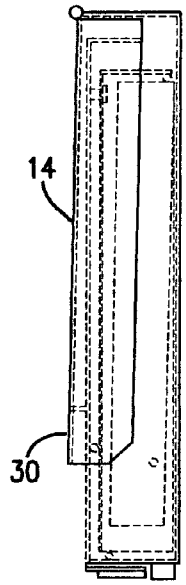
FIG. 3 is a side view of the container in a collapsed condition.
Figure 4:
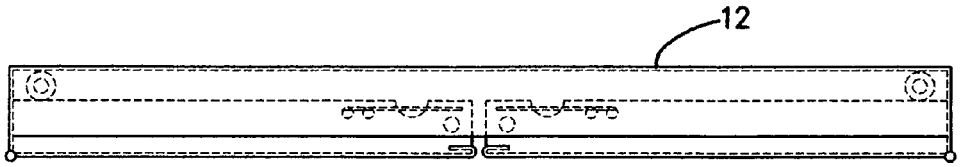
FIG. 4 is a top view of the side panels in the collapsed condition.

In the drawings, a collapsible container 10 includes a tray 12 having primary sheet members 14,16 and 18*a* and *b* hinged thereto to form the lid, base and side walls respectively of a box when assembled.

The base primary sheet member 16 is further hinged at 20 to a secondary sheet member 22 which forms the front wall of the box. The hinge is secured to a flange 24 on base 16.

Typically the tray 12 is anchored to a wall or other fixed surface, but the main object of the invention is that the tray is secured at a suitable point to a wall in the bin of a vehicle. Different version may be used as hotel wall safes, or secure storage area in trailers, boats or lockers.

All the sheet members have flanges 26 to prevent insertion of articles in an attempt to access the locked box. Flange 28 is inserted into a channel formation 30 formed along the front edge of the lid. The rear of the channel may form a locking surface for engaging locking arm 32.

Pins 34 are provided to secure the side walls to the base.

Catch mechanisms 36 are provided to secure the front wall to the side walls.

What is claimed is:

1. A collapsible container, comprising:

a tray with walls;

primary sheet members hinged to the walls of the tray, one of the primary sheet members being a base sheet member; and a secondary sheet member hinged along an edge to the base sheet member, the second sheet member serving as a front access member of an assembled closed box;

short flanges extending along at least two opposed free edges of the primary sheet members, the short flanges extending towards each other to overlay a zone of abutment of adjacent primary sheet members to prevent insertion of a prying instrument thereby preventing an inserted prying instrument forcibly opening the container; and a box lock, wherein, in a first position, the primary and secondary sheet members are pivotably positioned so all of the sheet members, except one exception member, are accommodated with the tray, the exception member forming a lid for the tray, in a second position, the primary and secondary sheet members form walls of the assembled closed box, the box lock locks the closed box, and the short flanges including recesses for receiving integral pins on the underside of the base sheet member for releasably engaging adjacent ones of the primary sheet members, wherein the secondary sheet member includes a flange along a third free edge thereof, the flange along the third free edge extending into an interior of the closed box to prevent forcible opening, and wherein the lid includes an angled section extending at least partly along a width of the lid to form a channel for receiving the flange along the third free edge of the secondary sheet member.

2. The collapsible container of claim 1, wherein, primary sheet members located at sides of the base sheet member comprise side walls of the closed box, and the flanges along bottom edges of the side walls include apertures for receiving integral pins on an underside of the base sheet member, the pins extending vertically through the apertures to hold together the side walls and the base sheet member.

* * * * *